US005340234A

United States Patent [19]

Rossi et al.

[11] Patent Number: 5,340,234

[45] Date of Patent: Aug. 23, 1994

[54] TRENCH DRAIN SYSTEM AND INSTALLATION METHOD

[76] Inventors: Anthony P. Rossi, 3331 Green Meadows La., Racine, Wis. 53405; Daniel W. Rosenberg, 5904 Middle Rd., Racine, Wis. 53402

[21] Appl. No.: 923,778

[22] Filed: Jul. 30, 1992

[51] Int. Cl.[5] ..... E02B 5/00

[52] U.S. Cl. ..... 405/48; 405/119; 405/154

[58] Field of Search ..... 405/118, 119, 120, 121, 405/122, 123, 38, 48, 36, 154, 156

[56] References Cited

U.S. PATENT DOCUMENTS

| | | | |
|---|---|---|---|
| 1,084,252 | 1/1914 | Burch . | |
| 4,134,268 | 1/1979 | Elmore | 405/43 |
| 4,340,081 | 7/1982 | Watson | 405/41 X |
| 4,630,966 | 12/1986 | Karbstein | 405/118 |
| 4,699,544 | 10/1987 | Karbstein | 405/118 |
| 4,787,773 | 11/1988 | Kehler | 405/118 |
| 4,815,888 | 3/1989 | Stegmeier | 404/4 |
| 4,844,655 | 7/1989 | Aleshire | 405/118 |
| 4,912,888 | 4/1990 | Martin | 405/119 X |
| 4,940,359 | 7/1990 | Van Duyn et al. | 405/118 |
| 4,993,877 | 2/1991 | Beamer | 405/282 |
| 4,993,878 | 2/1991 | Beamer | 405/282 |
| 5,035,092 | 7/1991 | Brant | 52/11 |
| 5,066,165 | 11/1991 | Wofford et al. | 405/119 |

FOREIGN PATENT DOCUMENTS

| | | | |
|---|---|---|---|
| 1079743 | 3/1984 | U.S.S.R. | 405/118 |
| 876470 | 9/1961 | United Kingdom | 405/119 |
| 916105 | 1/1963 | United Kingdom | 405/122 |

*Primary Examiner*—Randolph A. Reese
*Assistant Examiner*—J. Russell McBee
*Attorney, Agent, or Firm*—Jansson & Shupe, Ltd.

[57] ABSTRACT

A trench drain system for factory floors and the like having inherently-shaped partially-circumferenced homogeneous polymeric pipe members fused together to form a continuous integral pipe channel with a top opening having two edges, and support/anchor members secured along each of the edges to support the grate members and anchor the pipe members with respect to the floor. The system has integrity in form and is easily installed and adapted. A method for installing a trench drain system including fusing together inherently-shaped partially-circumferenced pipe members having two edges defining a top opening of desired width to form a continuous integral pipe channel, laying such pipe members in a trench in end-to-end fashion with said top openings up, and anchoring the pipe channel in the floor.

20 Claims, 5 Drawing Sheets

TRENCH DRAIN SYSTEM AND INSTALLATION METHOD

FIELD OF THE INVENTION

This invention relates generally to the field of trench drainage systems, and specifically, to a modular and componential trench drain system with a channel system, grate frames, grates and anchors.

BACKGROUND OF THE INVENTION

Trench drains are well known in the prior art. They are used in situations requiring drainage of water or other liquids from flat surfaces like factory floors and the like, including parking lots, building perimeters and roadways. The trench drain generally empties into a larger drainage conduit, a sewer, a collection means, or even into the earth (where appropriate) through one or more drain outlets. Additionally, trench drains typically have a grating flush with the surface to be drained, to prevent, among other things, entry into the trench drains of undesirable objects, such as feet or tires, or leaves, branches, and other debris.

Trench drains have been in existence for many years. There are many examples of trench drain systems in the prior art, including those disclosed in the following U.S. Pat. Nos.:

U.S. Pat. No. 5,066,165 (Wofford et al.)
U.S. Pat. No. 4,815,888 (Stegmeier)
U.S. Pat. No. 4,035,092 (Brant)
U.S. Pat. No. 4,630,966 (Karbstein)
U.S. Pat. No. 4,940,359 (Van Duyn et al.).

The trench drain systems of the prior art have several disadvantages in their installation and use:

For example, in the "thin wall" trench channel system disclosed in U.S. Pat. No. 5,066,165, problems arise due to the weak structural strength of the liner. Channel walls tend to buckle under pressure during installation as concrete is placed around them and have questionable durability and complicated installation procedures.

Certain "thick wall" trench channel systems also have a number of disadvantages. Due to the fact that the materials used in such systems are without sufficient resiliency, there exists a tendency for the channels to crack. More significant, however, is a disadvantage which results from the method by which the components are interconnected; the seals used to connect the heavy trench segments often leak and crack due to pressure on the seals, such as that caused by heavy factory floor loads and stresses. The interconnections generally form weak points in the channel system.

Another disadvantage and problem is the high costs and complexities found in the installation of both of these systems. The thick wall systems are heavy and are costly to transport to the site due to the material of manufacture, usually steel, concrete or a similar material. Additionally, due to the weight of the thick wall system components, there is a high degree of difficulty in the installation of such a system. On the other hand, the thin wall systems, which involve a liner with concrete support, are extremely complex in design and, therefore, make installation very complicated.

Furthermore, the systems of the prior art are not readily adaptable. That is, post-installation revisions in the system are very difficult and costly.

OBJECTS OF THE INVENTION

It is an object of this invention to provide an improved trench drain system and trench drain system installation method overcoming some of the shortcomings and problems of the prior art, including those mentioned above.

Another object of this invention is to provide a trench system which overcomes the problem of failed seals and has greatly improved leak resistance.

Another object of this invention is to provide a trench drain system which is inexpensive and relatively easy to install.

Another object of this invention is to provide a trench drain system which is easily adaptable for desired changes in the system.

A further object of this invention is to provide a trench drain system which is durable, resistant to collapse, lightweight and easy to maintain.

How these and other objects are accomplished will become apparent from the following descriptions and the drawings.

SUMMARY OF THE INVENTION

The invention overcomes the shortcomings and problems of the prior art, including those mentioned above, by providing an improvement to trench drain systems which are installed in and below the level of a factory floor or the like and have removable floor-level grate members which admit liquids to the systems. Such improvements create a structurally strong, lightweight, and easily installed drainage system.

The trench drain system of this invention includes a number of inherently-shaped (that is, substantially rigid) partially-circumferenced homogeneous polymeric pipe members fused together to form a continuous integral pipe channel with a top opening having two edges. The device also includes a means to support and anchor the integral pipe channel with respect to the floor, such support/anchor means being secured along the edges of the pipe channel. The invention provides a drain system in which the form and integrity are enhanced. The system is easy to install and is readily adaptable when changes in the system are desired.

In certain preferred embodiments, the pipe members have a substantially uniform thickness of at least about $\frac{3}{8}$ inch. In such embodiments, the pipe members are able to withstand outside pressures, for example, loads from factory floor traffic or the like, despite the forces exerted on the system.

In highly preferred embodiments of this invention, the fusing of the partially-circumferenced pipe members is produced by solvent-welding. The fusing of pipe members most preferably involves a partially-circumferenced homogeneous polymeric coupling having opposite ends fused to adjacent pipe members, each in a continuous integral fashion.

The trench pipe system of this invention preferably has one or more of the pipe members with drain outlets. In a highly preferred embodiment, the drain outlet is formed by an outlet tube which is integral with the pipe member. Connections to such an outlet and outlet tube may be by fusing to form continuous integral connection.

In highly preferred embodiments, the pipe channel is supported by contact between its exterior surface center portion and the trench bottom. In a particularly preferred form, the pipe channel is further supported by concrete injected into the space below the exterior surface, usually on either side of the contact between the exterior surface center portion of the pipe channel and the trench bottom.

In certain preferred embodiments, each support piece includes an elongate metal bar having horizontally- and vertically-offset upper and lower flat portions joined by a substantially vertical flat portion. It is preferred that the flat portions be integrally formed. Also, a number of anchor braces are spaced along and connected to the bar beneath the upper flat portion and extend outwardly and downwardly for concrete engagement. Such anchor braces are most typically integrally secured to the metal bars, such as by welding them to the support pieces.

In a highly preferred embodiment, the upper flat portion of the bar member is flush with the level of the floor and the lower flat portions of the bar members provide grate member support. The substantially vertical flat portion of the bar member preferably engages and is attached to the interior surface of the pipe channel.

The trench drain installation method of this invention includes: providing inherently-shaped partially-circumferenced pipe members having two edges defining a top opening of desired width; fusing the pipe members together in an end-to-end fashion to form a continuous integral pipe channel; laying the pipe members in the trench, such step being carried out in any order with respect to the fusing step; and anchoring the pipe channel in the floor. Such installation method is easy and provides a drain system of enhanced form, integrity and adaptability.

In one form of the method of this invention, the partially-circumferenced pipes are made from inherently-shaped cylindrical pipe members of homogeneous polymeric material by removing a circumferential portion of each such pipe member along its length to form a partially-circumferenced pipe with two edges which define a top opening of desired width.

In one preferred form of the method of this invention, the pipe members are fused together to form the integral pipe channel and then the pipe channel is lowered into the trench. As noted above, the pipe channel is supported by contact between the exterior surface center portion and the trench bottom to create space below the pipe channel exterior. And, in certain preferred embodiments, there is the further step of injecting concrete into the space to provide further pipe channel support.

The term "partially-circumferenced" as used herein includes the pipe members of a partially cylindrical cross-section; however, the term includes non-circular cross-sections, including U-shaped or other shapes. "Partially-circumferenced" refers to the opening extending along the length of the pipe.

The term "continuous integral" indicates that the pipe channel is such that there are no breaks or bonding areas along the pipe channel; instead, the pipe members, upon fusing, become one single homogeneous polymeric piece. That is what is meant by "fused" together.

The concept of "fusing" or "fused together" includes the concept of direct pipe section to pipe section fusing or, in highly preferred embodiments, the utilization of a coupling of homogeneous polymeric material similar to the material of the pipe members, which upon fusing with the adjacent pipe members onto its opposite ends becomes integral with the remainder of the continuous pipe channel.

DETAILED DESCRIPTION OF PREFERRED EMBODIMENTS

Figure 1:
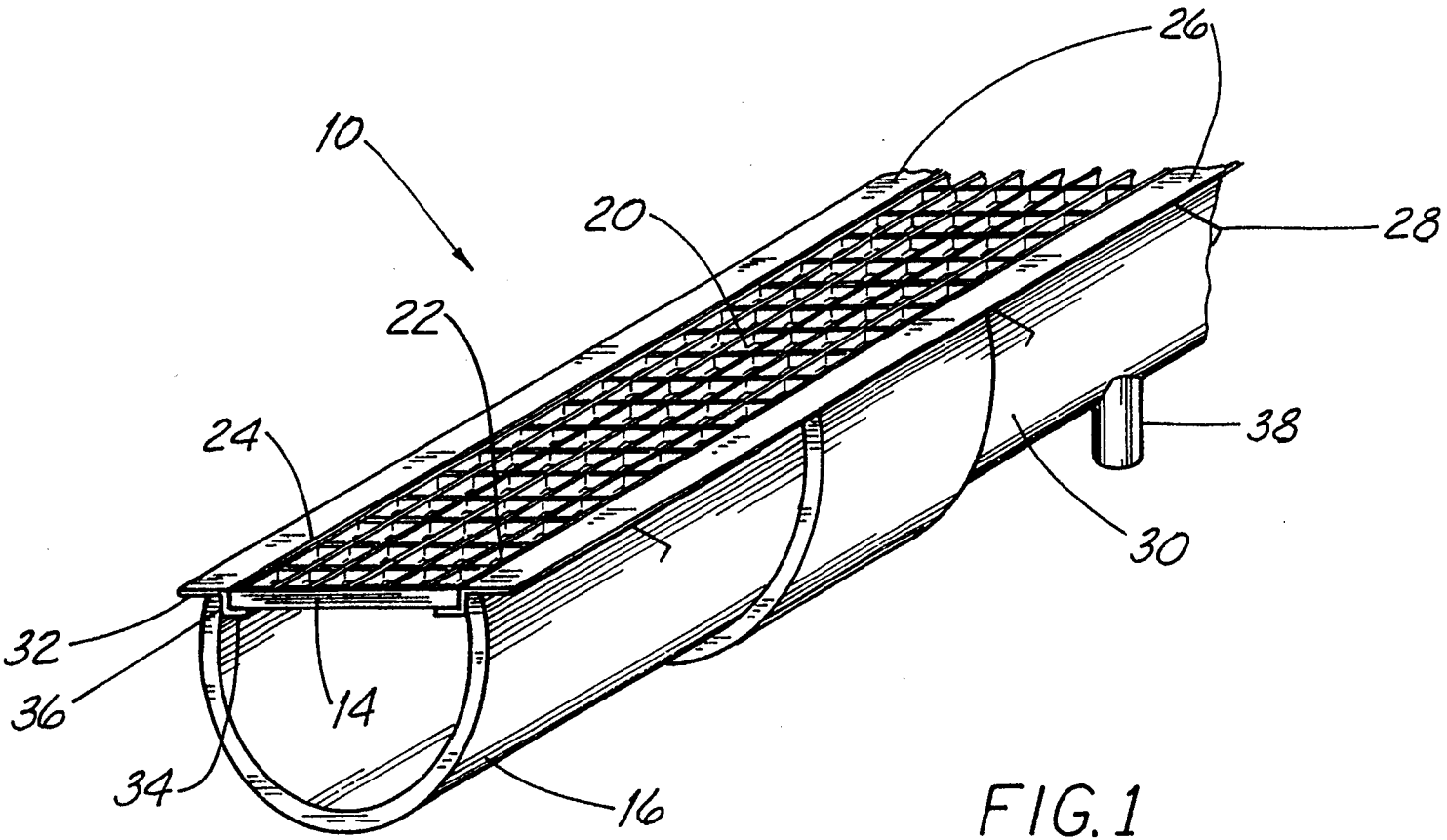
FIG. 1 is a perspective view of the preferred embodiment in accordance with this invention.

The figures illustrate two preferred embodiments of an improved trench drain system 10 of the type for installation in a trench 12 in and below the level of a factory floor or the like and having removable floor-level grate members 14 for admitting liquids to the system 10.

Trench drain system 10 includes a plurality of inherently-shaped (that is, substantially rigid) partially-circumferenced homogeneous polymeric pipe members 16 fused together with a coupling 18 to form a continuous integral pipe channel with a top opening 20 having two edges 22, 24 and support means 26 and anchor members 28 secured along each of the edges to support grate members 14 and anchor pipe members 16 with respect to the floor.

The figures illustrate pipe channel 30 which is generally a partial cylinder with a circumferential portion removed along its length, thereby creating top opening 20, into which liquids enter trench drain system 10, and two edges 22, 24. Pipe channel 30 includes pipe members 16 which are integrally connected by fusing pipe members 16 together with couplings 18, thereby providing trench drain system 10 a pipe channel of continuous material with no structural breaks or seals.

Pipe channel 30 has a substantially uniform thickness of about $\frac{3}{8}$ inch. This provides the structural integrity and strength which will withstand outside pressures, such as above-ground traffic or the contraction and expansion of the surrounding floor, upon system 10.

Attached to each of edges 22, 24 are support means 6 for grate members 14. Support means 26 includes horizontally- and vertically-offset upper and lower flat metal bar members 32 and 34, respectively, joined by a substantially vertical flat metal bar member 36. Upper flat members 32 are positioned such that they are flush with the level of the floor. Lower flat members 34 provide support for grate members 14 which are placed on top of lower flat members 34. Support means 26 and grate members 14 are of such size and strength such that they are flush with the floor and are able to support above-ground traffic. Support means 26 is generally Z-shaped in form. Attached to support means 26 are anchor members 28 beneath upper flat members 32. Anchor members 28 extend outwardly and downwardly and are set in concrete to provide additional stability for trench drain system 10. Anchor members 28 are L-shaped. Support means 26, to which anchor members 28 are secured, is itself secured to the interior surface of pipe channel 30.

Trench drain system 10 also has a pipe member 16 which has a drain outlet tube 38 integrally connected or formed therewith.

Figure 2:
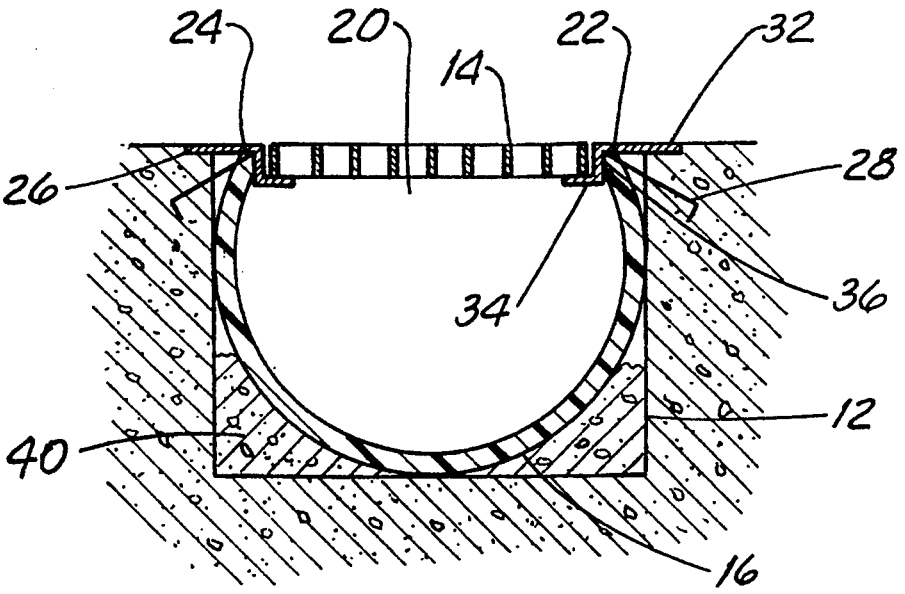
FIG. 2 is a cross-sectional frontal view of the preferred embodiment.
Figure 4:
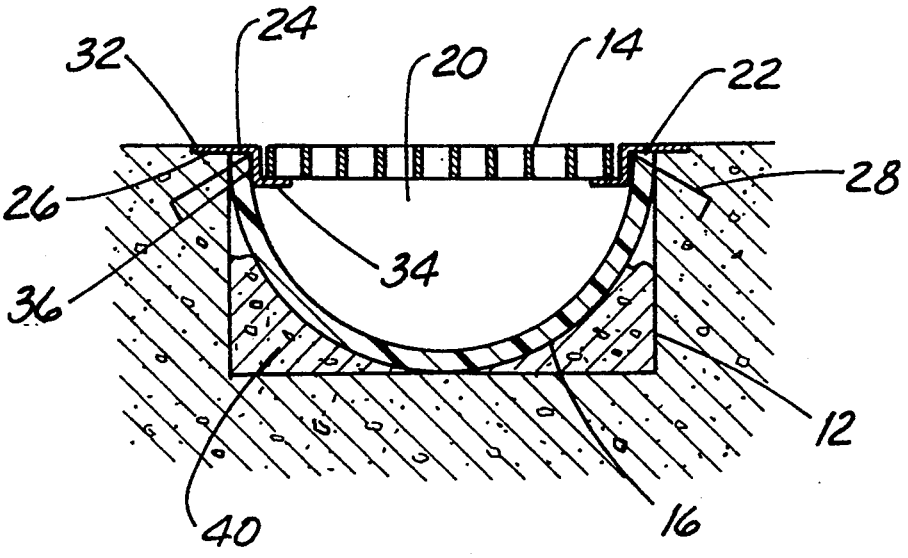
FIG. 4 is a cross-sectional view of a second preferred embodiment.
Figure 3:
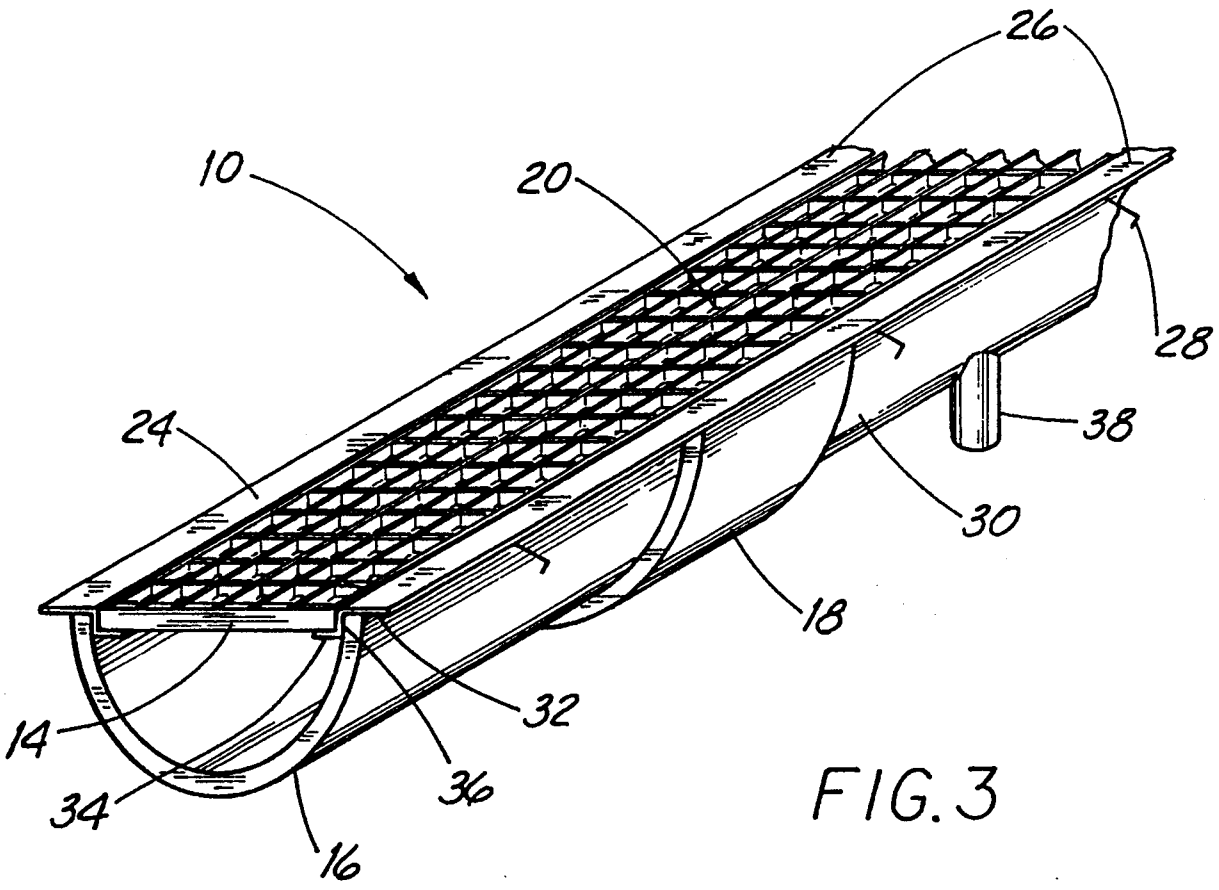
FIG. 3 is a perspective view of a second preferred embodiment with a larger circumferential section removed from the pipe member than FIG. 1.

Referring to FIGS. 2 and 4, pipe channel 30 is supported by contact between it and the bottom of trench 12. Pipe channel 30 is further supported by concrete filled in spaces 40 between pipe channel 30 and trench 12.

Figure 5:
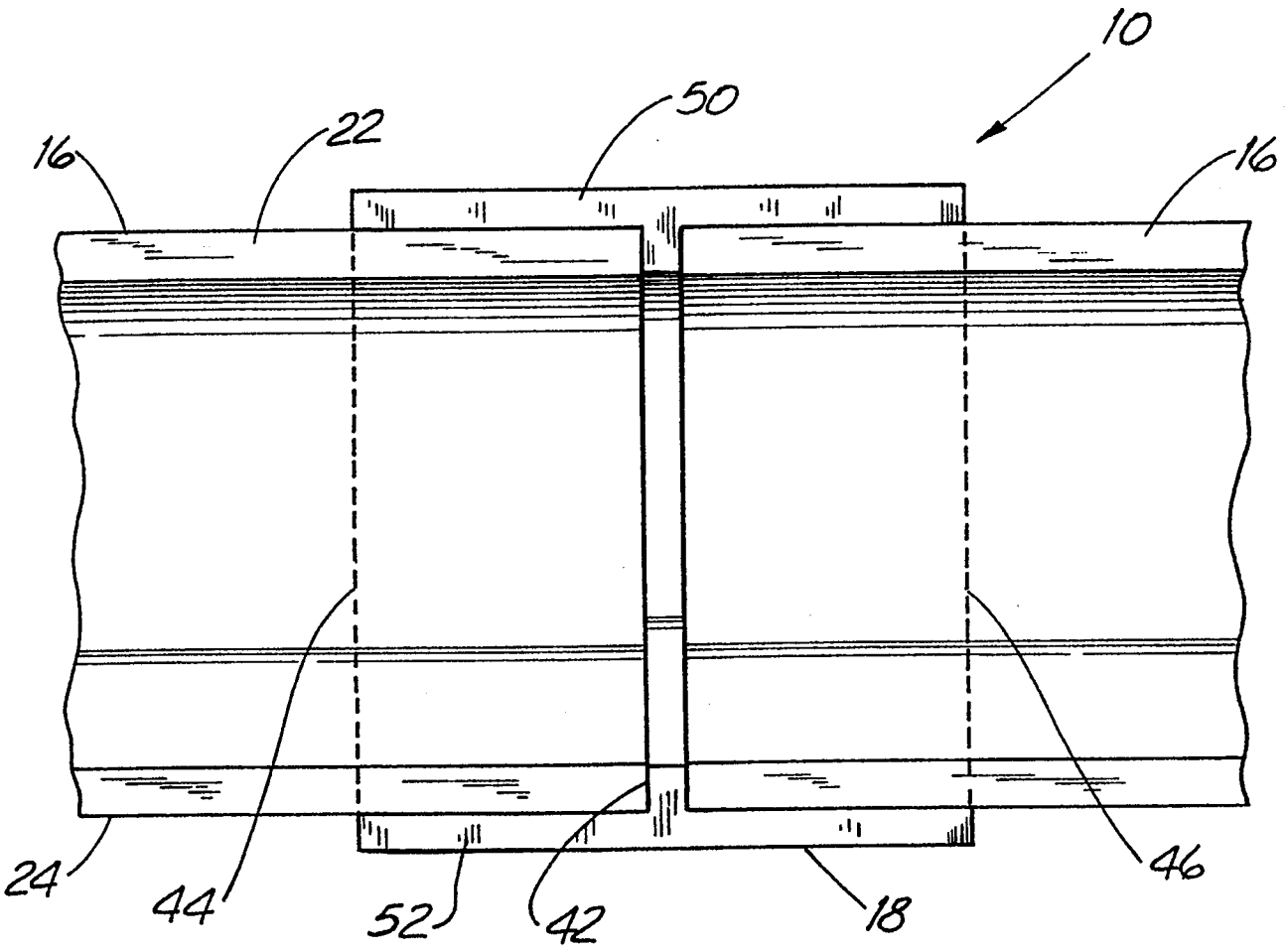
FIG. 5 is a cross-sectional top view of the coupling described in the preferred embodiment showing the ends of pipe members engaged with the coupling.
Figure 6:
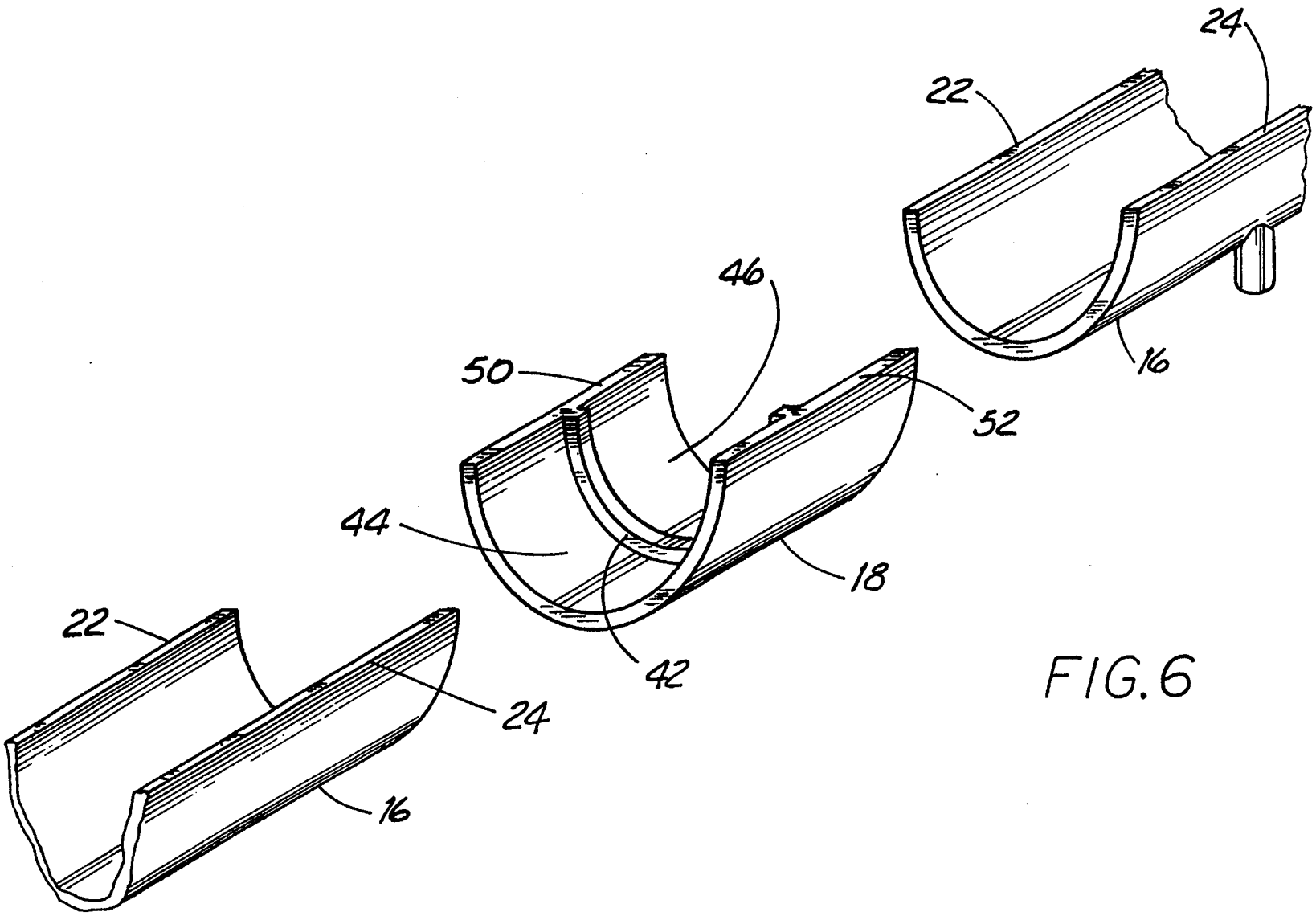
FIG. 6 is an exploded view of the coupling and two pipe members.

FIG. 5 and 6 illustrate the engagement of pipe members 16 with coupling 18. Coupling 18 has a partial ring 42, two open ends 44, 46, and a top opening 48 with two edges 50, 52. Pipe members 16 are positioned in the interior of coupling 18 such that the ends of the pipe members, which enter through open ends 44 and 46, are positioned adjacent to partial ring 42. Pipe member edges 22 and 24 are aligned such that they are even with coupling edges 50, 52. The ends of pipe members 16 are fused by way of solvent welding in the preferred embodiment to coupling 18 in the described position, whereby the fused connection creates a continuous pipe channel 30.

Solvent welding is by techniques well known joining certain kinds of polymeric members of common polymeric material. For example, using PVC pipe members, a solvent agent such as IPS "Weld-On" solvent welding agent is useful, after priming in known manner.

While the preferred embodiments show two versions of trench drain system 10 with pipe channels 16 of differing heights, it should be understood clearly that the size and height of such pipe channels 16 is not limited by such described embodiments.

While the principles of this invention have been described in connection with specific embodiments, it should be understood clearly that these descriptions are made only by way of example and are not intended to limit the scope of the invention.

We claim:

1. In a trench drain system of the type for non-molding installation in a trench in and below the level of a floor and having removable floor-level grate members for admitting liquids to the system, the improvement comprising:

a plurality of preformed substantially rigid partially-circumferenced open-top homogeneous polymeric pipe members, each adjacent pair of such pipe members having an adjoining pair of partially-circumferenced end edges fused together to form a continuous integral fluid-tight drain pipe channel with a top opening having two opposed elongate edges extending along the length of such drain pipe channel to define a substantially open channel; and support/anchor means secured along each of the edges to support the grate members and anchor the pipe members with respect to the floor;

whereby drain system form and integrity are enhanced and ease of installation and system adaptability provided.

2. The trench drain system of claim 1 wherein at least one of the partially-circumferenced pipe members has a drain outlet.

3. The trench pipe system of claim 2 wherein the drain outlet is formed by an outlet tube which is fused together with the pipe channel to be integral therewith.

4. The trench drain system of claim 1 wherein the pipe members are fused by solvent-welding.

5. The trench drain system of claim 1 wherein at least one such fusing of pipe members includes a partially-circumferenced homogeneous polymeric coupling having opposite ends fused to adjacent pipe members in continuous integral fashion.

6. The trench drain system of claim 1 wherein the trench has a trench bottom and wherein:

the pipe channel has an exterior surface including a center portion opposite its top opening; and the pipe channel is supported by contact between the exterior surface center portion and the trench bottom.

7. The trench drain system of claim 6 wherein the pipe channel is further supported by concrete below the exterior surface.

8. The trench drain system of claim 1 wherein each of the pipe members has a substantially uniform thickness ms of at least about $\frac{3}{8}$ inch.

9. The trench drain system of claim 1 wherein each said support/anchor means comprises:

an elongate metal bar member having horizontally- and vertically-offset upper and lower flat portions joined by a substantially vertical flat portion; and a plurality of anchor members spaced along and connected to the bar member beneath the upper flat portion and extending outwardly and downwardly for concrete engagement.

10. The trench drain system of claim 9 wherein the flat portions are integrally formed together.

11. The trench drain system of claim 10 wherein the anchor members are integrally secured to the metal bar members.

12. The trench drain system of claim 10 wherein the pipe channel has an interior surface and the substantially vertical flat portion of the bar member is attached to the interior surface.

13. The trench drain system of claim 10 wherein the upper flat portion of the bar member is flush with the level of the floor.

14. The trench drain system of claim 13 wherein the lower flat portions of the bar members provide grate member support.

15. A method for molding-free installation of a trench drain system of the type in a trench in and below the level of a floor and having removable floor-level grate members for admitting liquids to the system, comprising:

providing preformed substantially rigid homogeneous polymeric pipe members;

removing a circumferential portion of each of such pipe members along its length to form partially-circumferenced pipe members, each of the pipe members having partially-circumferenced end edges and two opposed elongate edges extending along its length, the elongate edges defining a gap of desired width therebetween;

securing along each of the edges support/anchor means to support the grate members and anchor the pipe members with respect to the floor;

fusing adjacent pairs of the pipe members together in end-to-end aligned fashion, each adjacent pair of pipe members having and adjoining pair of the partially-circumferenced end edges fused together to form a continuous integral fluid-tight drain pipe channel with an elongate top opening having elongate edges extending along the length of such drain pipe channel to define a substantially open channel, said elongate top opening and elongate edges being formed by the alignment of the gaps and the opposed edges of the pipe members, respectively;

in any order with respect to said fusing step, laying such pipe members in said trench in end-to-end fashion with said top openings up; and anchoring the pipe channel in the floor by securing the support/anchor means with respect thereto;

whereby a drain system with enhanced form, integrity and adaptability is easily installed.

16. The method of claim 15 wherein the pipe members are fused together to form the integral pipe channel and thereafter the pipe channel is lowered into the trench.

17. The method claim 15 wherein the fusing step includes solvent-welding.

18. The method of claim 15 wherein the trench has a trench bottom, the pipe channel has an exterior surface with a center portion opposite its top opening, and the pipe channel is supported by contact between the exterior surface center portion and the trench bottom to create space below the pipe channel exterior, and including the further step of subsequently injecting concrete into the space, thereby to providing further pipe channel support.

19. A method for molding-free installation of a trench drain system of the type in a trench in and below the level of a floor and having removable floor-level grate members for admitting liquids to the system, comprising:

providing preformed substantially rigid partially-circumferenced pipe members each having partially-circumferenced end edges and two opposed elongate edges extending along its length and defining a gap of desired width therebetween;

fusing the pipe members together in end-to-end aligned fashion, each adjacent pair of pipe members having an adjoining pair of the partially-circumferenced end edges fused together to form a continuous integral fluid-tight drain pipe channel with an elongate top opening having elongate edges extending along the length of such drain pipe channel to define a substantially open channel, said elongate top opening and elongate edges being formed by the alignment of the gaps and the opposed edges of the pipe members, respectively;

in any order with respect to said fusing step, laying such pipe members in said trench in end-to-end fashion with said to openings up; and anchoring the pipe channel in the floor;

whereby a drain system with enhanced form, integrity and adaptability is easily installed.

20. The method claim 19 wherein the fusing step includes solvent-welding.

* * * * *

UNITED STATES PATENT AND TRADEMARK OFFICE

CERTIFICATE OF CORRECTION

PATENT NO. : 5,340,234

DATED : August 23, 1994

INVENTOR(S) : Anthony P. Rossi and Daniel W. Rosenberg

It is certified that error appears in the above-indentified patent and that said Letters Patent is hereby corrected as shown below:

In column 4, line 51, change "6" to --26--.

Column 5:
In claim 3, line 1, delete "pipe" and insert --drain--.

Column 6:
In claim 8, line 3, delete "ms".

Column 8:
In claim 19, the fourth to the last line, change "to" to --top--.

Signed and Sealed this

First Day of November, 1994

*Attest:*

Bruce Lehman

BRUCE LEHMAN

*Attesting Officer*

*Commissioner of Patents and Trademarks*